US007147257B2

(12) United States Patent
Johansen et al.

(10) Patent No.: US 7,147,257 B2
(45) Date of Patent: Dec. 12, 2006

(54) STRIKER ASSEMBLY WITH LEVER

(75) Inventors: Kurt Johansen, Powell, OH (US); Steven Thiele, Marysville, OH (US); Kenichi Kitayama, Dublin, OH (US)

(73) Assignee: Honda Motor Co., Ltd., Tokyo (JP)

( * ) Notice: Subject to any disclaimer, the term of this patent is extended or adjusted under 35 U.S.C. 154(b) by 179 days.

(21) Appl. No.: 10/894,630

(22) Filed: Jul. 20, 2004

(65) Prior Publication Data

US 2006/0006680 A1 Jan. 12, 2006

Related U.S. Application Data

(60) Provisional application No. 60/583,710, filed on Jun. 29, 2004.

(51) Int. Cl.
*E05B 15/02* (2006.01)

(52) U.S. Cl. ..... 292/341.15; 292/341.17

(58) Field of Classification Search ..... 292/216, 292/340, 341, 341.15, 341.17, DIG. 21
See application file for complete search history.

(56) References Cited

U.S. PATENT DOCUMENTS

| | | | | |
|---|---|---|---|---|
| 2,286,739 | A * | 6/1942 | Krause | 292/341.19 |
| 3,454,299 | A | 7/1969 | Hewitt et al. | |
| 3,572,065 | A | 3/1971 | Peters | |
| 3,572,797 | A | 3/1971 | Shay | |
| 3,596,957 | A | 8/1971 | Gionet | |
| 3,796,452 | A * | 3/1974 | Foster et al. | 292/341.16 |
| 3,799,594 | A | 3/1974 | Watermann | |
| 4,007,955 | A * | 2/1977 | Kobayashi | 292/216 |
| 4,775,178 | A | 10/1988 | Boyko | |
| 4,842,313 | A | 6/1989 | Boyko et al. | |
| 5,342,103 | A | 8/1994 | Tame et al. | |
| 5,707,092 | A | 1/1998 | Van Slembrouck et al. | |
| 5,707,095 | A | 1/1998 | Pribak et al. | |
| 6,273,480 | B1 | 8/2001 | Burton | |

FOREIGN PATENT DOCUMENTS

| | | |
|---|---|---|
| JP | 2520786 | 10/1996 |
| JP | 2001-115714 | 4/2001 |

* cited by examiner

*Primary Examiner*—Gary Estremsky
(74) *Attorney, Agent, or Firm*—Fay, Sharpe, Fagan, Minnich & McKee, LLP

(57) ABSTRACT

A striker assembly is provided for use with a lock assembly in latching a first body and a second body together and allowing at least one of the first and second bodies to pivotally move relative to the other of the first and second bodies. The lock assembly is mounted to the first body. The striker assembly includes a striker rotatably mounted to the second body and configured so that an associated latch of the lock assembly is selectively lockable to the striker to latch the first body to the second body. A lever extends from the striker and is engageable with the lock body so that the striker rotates when said at least one of the first and second bodies is pivotally moved relative to the other of the first and second bodies.

21 Claims, 9 Drawing Sheets

STRIKER ASSEMBLY WITH LEVER

This application claims priority of Provisional Patent Application Ser. No. 60/583,710, filed Jun. 29, 2004, entitled "Striker Assembly With Lever".

BACKGROUND

The present invention relates to a vehicle striker assembly to which a latch assembly connects and, more particularly, to a striker assembly having a rotatably mounted striker pin and a lever fixedly connected to the striker pin for rotation therewith. In one embodiment, the striker pin assembly is provided for use in conjunction with a dual-mode tailgate and will be described with particular reference thereto. It is to be appreciated, however, that the invention may relate to other similar environments and applications.

Strikers are often employed in vehicle applications for providing a structure to which a latch or lock may be secured. For example, closure devices on vehicles often include latching or locking assemblies that latch onto a striker disposed on a vehicle main body for purposes of securing or locking the closure device in a desired position. In some applications, the closure device may be a door or tailgate pivotally connected to a vehicle main body and the striker may be used for latching the closure device in a closed position.

Strikers and the latching devices that connect thereto are known to wear as a result of repeated contact therebetween. Significant wear on the striker and/or the latching device can ultimately result in a failure of the latching device and/or can lead to undesirable noise associated with each latching onto the striker. The wear problem is exasperated when, in addition to selectively latching onto the striker, the closure structure is pivotally moveable about the striker or a pivot axis defined by the striker.

An example of a closure structure that both latches onto a striker and pivots about the striker or a pivot axis defined by the striker is a dual-mode tailgate. More particularly, a dual-mode tailgate typically includes one or more strikers to which locking assemblies of the dual-mode tailgate latch. The one or more strikers also define one or more respective pivot axes about which the tailgate is moveable for opening of the tailgate in one of its dual modes. The one or more strikers are subjected to engagement wear whenever the locking assemblies are latched to the one or more strikers and, additionally, whenever the tailgate is pivotally moved toward one of its open positions.

"Dual-mode" typically refers to at least two directions or pivot axes along which a dual-mode tailgate is openable. Often, the dual-mode tailgate is selectively openable in a first, fold-down direction about an axis generally parallel with a bottom edge of the tailgate similar to a conventional pick-up truck tailgate and, alternatively, a second, side-to-side direction about an axis generally parallel with a lateral edge of the tailgate.

Generally, a dual-mode tailgate includes a dual-mode hinge pivotally connecting the tailgate to the vehicle main body, a first hinge/lock assembly spaced apart from the dual-mode hinge in a first direction and a second hinge/lock assembly spaced apart from the dual-mode hinge in a second direction. The first hinge/lock assembly selectively latches onto a first striker mounted to the vehicle main body and pivotally moves about a first axis defined by the first striker when the second hinge/lock assembly is unlatched from a second striker mounted to the vehicle main body. The second/hinge lock assembly selectively latches onto the second striker and pivotally moves about a second axis defined by the second striker when the first hinge/lock is unlatched from the first striker.

In an exemplary dual-mode tailgate, the dual-mode hinge is positioned in a lower-left corner of the tailgate, the first hinge/lock assembly is positioned in a lower-right corner of the tailgate and the second hinge/lock assembly is positioned in an upper-left corner of the tailgate. When the first hinge/lock assembly is detached from the first striker, the tailgate is openable in a first mode (e.g., swing-open mode) wherein the second hinge/lock assembly and the dual-mode hinge cooperate to pivotally connect the tailgate to the vehicle main body along the first axis (e.g., an axis generally parallel with a lateral edge of the tailgate). When the tailgate is opened in the first mode, the second hinge/lock pivots or rotates about the first axis which is at least partially defined by the first striker.

When the second hinge/lock is detached from the second striker, the tailgate is openable in a second mode (e.g., flip-down mode) wherein the first hinge/lock assembly and the dual-mode hinge cooperate to pivotally connect the tailgate to the vehicle main body along the second axis (e.g., an axis generally parallel with a bottom edge of the tailgate). When the tailgate is opened in the second mode, the first hinge/lock pivots or rotates about the second axis which is at least partially defined by the second striker. Often, a lock assembly is provided in a corner of the tailgate catty-corner or diagonally opposite the dual-mode hinge to further secure the tailgate to the vehicle when the tailgate is in a closed position.

Any improvements to striker assemblies, particularly improvements that limit wear or extend the useful life of the striker assembly and/or the latching device, are deemed desirable. Further, any improvements that limit wear of the striker assembly and/or the latching device in applications where the striker assembly serves a pivot point, in addition to serving as a structure for latching, are deemed desirable.

BRIEF SUMMARY

In accordance with one aspect, a striker assembly is provided for use with a lock assembly in latching a first body and a second body together and allowing at least one of the first and second bodies to pivotally move relative to the other of the first and second bodies. The lock assembly is mounted to the first body. The striker assembly includes a striker rotatably mounted to the second body and configured so that an associated latch of the lock assembly is selectively lockable to the striker to latch the first body to the second body. A lever extends from the striker and is engageable with the lock body so that the striker rotates when said at least one of the first and second bodies is pivotally moved relative to the other of the first and second bodies.

In accordance with another aspect, a striker assembly is provided for use with a lock assembly in latching a closure structure on a vehicle, such as a door or tailgate, and allowing the closure structure to rotatably move relative to a vehicle body. More particularly, the striker assembly includes a mounting bracket secured to the vehicle body. A striker pin is rotatably mounted to the mounting bracket for latching engagement by a latching assembly of the closure structure. A lever radially extends from the striker pin for mating engagement by the latching assembly and to rotate the striker pin when the closure structure is rotatably moved relative to the vehicle body.

In accordance with yet another aspect, a striker assembly is provided for latching onto when locking a tailgate to a vehicle. The tailgate includes a locking assembly having a latch. The striker assembly includes a striker rotatably mounted to the vehicle for latching engagement with the latch when locking the locking assembly of the tailgate to the vehicle. The striker defines a pivot axis about which the tailgate is pivotable. A lever extends from the striker for mating engagement with the locking assembly. The lever rotates the striker when the tailgate with the locking assembly is pivotally moved about the pivot axis.

BRIEF DESCRIPTION OF THE DRAWINGS

The one or more embodiments may take form in various components and arrangements of components, and in various steps and arrangements of steps. The drawings are only for purposes of illustrating the one or more embodiments and are not to be construed as limiting the invention.

DETAILED DESCRIPTION

Figure 1:
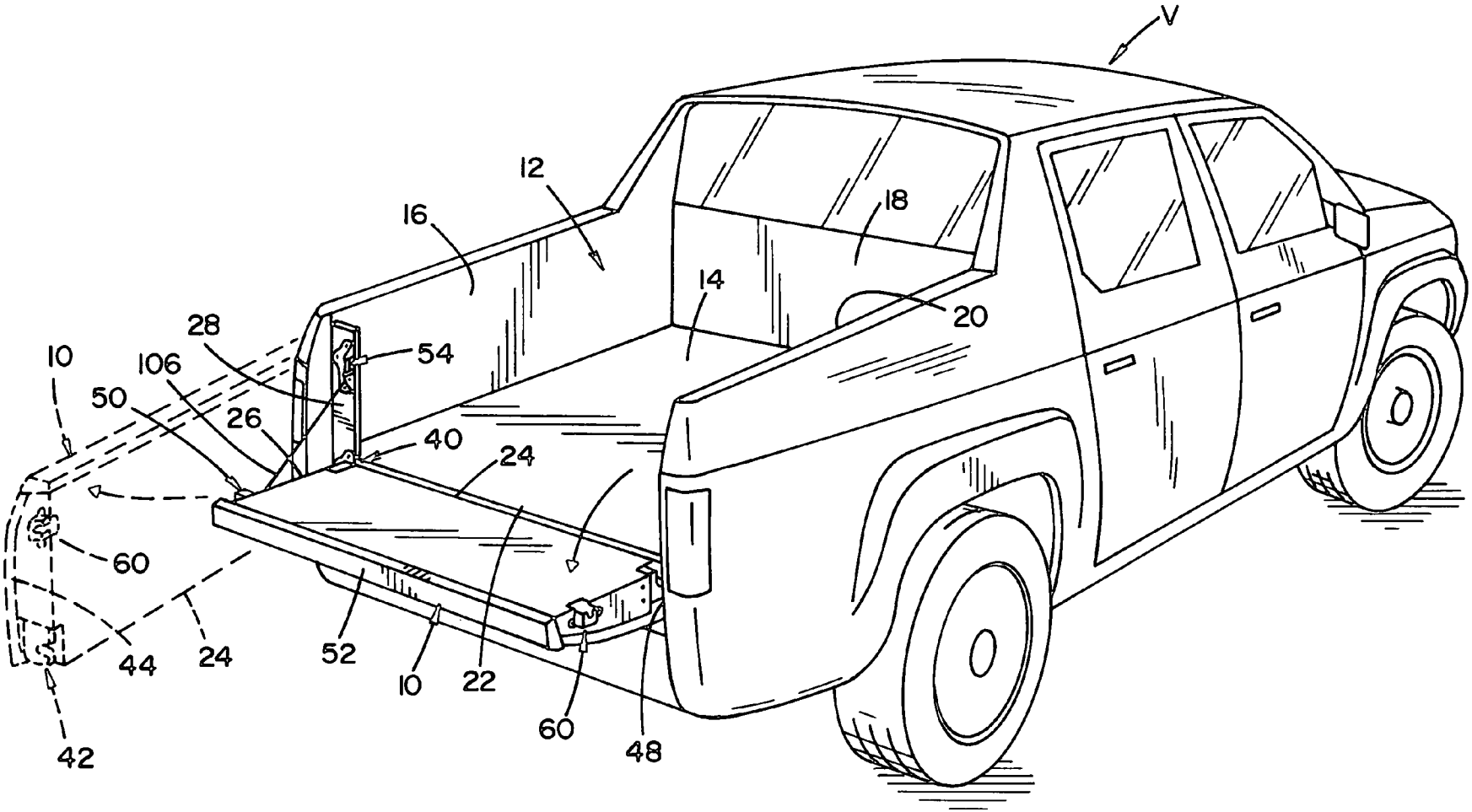
FIG. 1 is a perspective view of a vehicle having a dual-mode tailgate.

Referring now to the drawings wherein the showings are for purposes of illustrating one or more embodiments only and not for purposes of limiting the same, with reference to FIG. 1, a closure structure or assembly, such as a dual-mode tailgate 10, is shown as a component of a load-carrying bed of a vehicle V. In the illustrated embodiment, the vehicle V is a sport utility truck (SUT), but it is to be appreciated by those skilled in the art that the vehicle V could be any other type of vehicle having a bed, such as a pickup truck, utility truck, or other vehicle. Generally, the bed 12 includes a bed floor 14 having a plurality of walls 16, 18,20 extending upwardly adjacent three edges thereof and forming a portion of a vehicle body of the vehicle V.

The tailgate 10 is positioned along an open, rear edge 22 of the bed floor 14. More particularly, the tailgate 10 extends between first and second sidewalls 16,20 to selectively close an open end of the load-carrying bed 12. The tailgate 10 is mounted to the vehicle V and is able to pivot about a first axis for movement between a closed position (FIG. 2) and a fold-open position shown in FIG. 1. In the illustrated embodiment, the first axis is generally horizontal and parallel with the rear edge 22 of the bed floor 14 and a bottom edge 24 of the tailgate 10. The tailgate 10 is also alternatively able to pivot about a second axis for movement between the closed position and a swing-open position shown in phantom in FIG. 1. In the illustrated embodiment, the second axis is generally vertical and parallel with a first lateral edge 26 of the tailgate and a first sidewall end 28.

Figure 2:
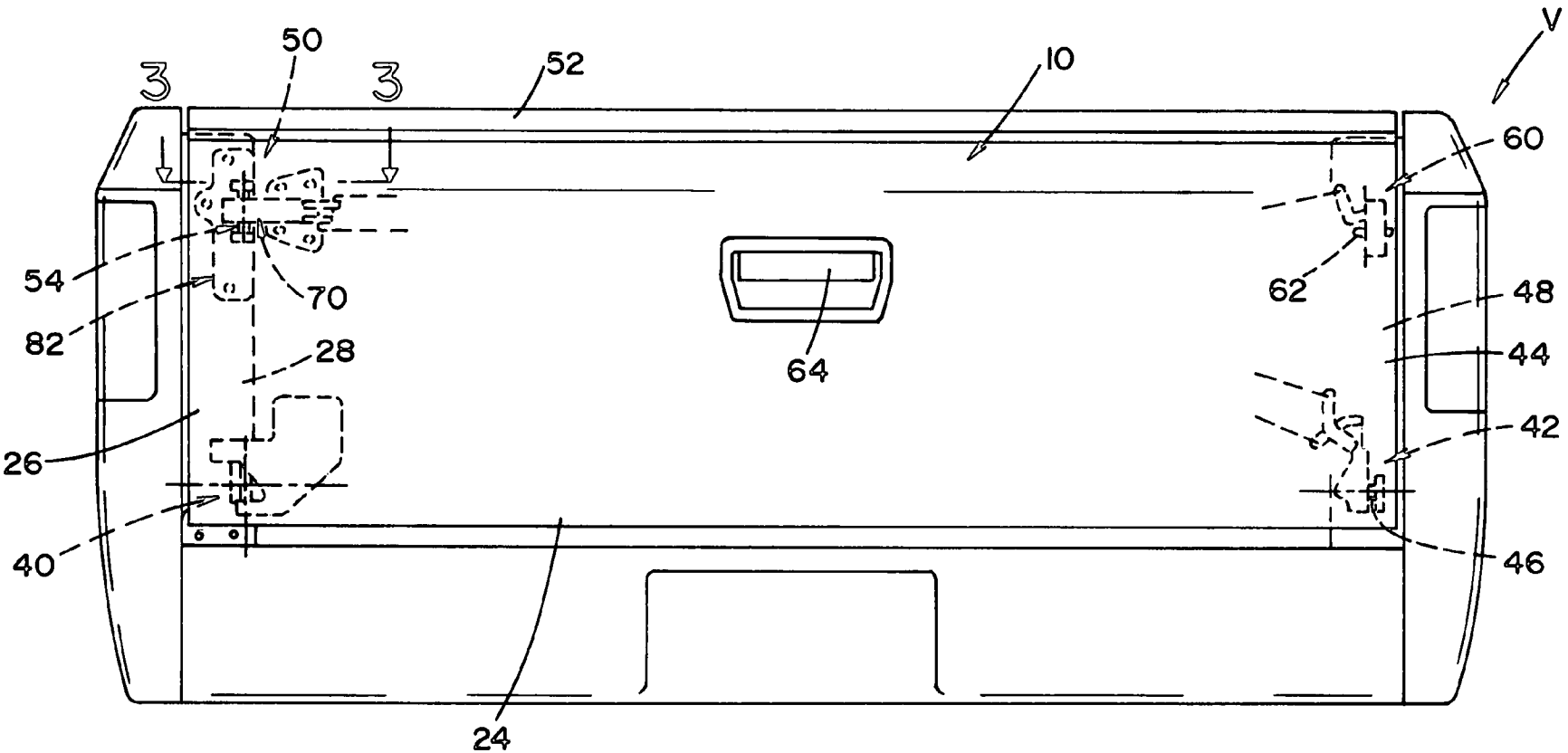
FIG. 2 is a partial rear elevational view of the tailgate and vehicle showing, in hidden lines, a dual-mode hinge, a first hinge/lock assembly, a second hinge/lock assembly and a locking assembly.

To facilitate the dual-mode action of the tailgate 10, with additional reference to FIG. 2, a dual-mode hinge assembly 40 attaches or is mounted to the tailgate at or adjacent a first corner of the tailgate formed at the intersection of the bottom edge 24 and the first lateral edge 26 of the tailgate. The dual-mode hinge assembly 40 pivotally connects the tailgate 10 along the first and second axes to the vehicle V. More specifically, the hinge assembly 40 pivotally connects to the sidewall end 28 adjacent the rear edge 22 for movement about the first axis and alternative movement about the second axis. In one embodiment, the dual-mode hinge assembly is that described in commonly owned, U.S. patent application Ser. No. 10/663,581, entitled "Tailgate Dual Mode Hinge With Integrated Checker" and filed on Sep. 16, 2003, expressly incorporated herein by reference.

A first hinge/lock assembly 42 attaches or is mounted to the tailgate 10 spaced from the hinge assembly 40 in a first direction. More specifically, the hinge/lock assembly 42 is mounted at or adjacent a second corner of the tailgate formed at the intersection of the bottom edge 24 and a second lateral edge 44 of the tailgate. The first hinge/lock assembly 42 selectively latches or locks to a first hinge/lock striker 46 to releasably lock the tailgate 10 to the vehicle V. The striker 46 is mounted to or a adjacent a second sidewall end 48 adjacent the rear edge 22 of the bed floor 14. When operating as a hinge, the first hinge/lock assembly 42 cooperates with the hinge assembly 40 to pivotally support the tailgate along or about the first axis and allows the tailgate to move between the closed position and the fold-open position.

A second hinge/lock assembly 50 attaches or is mounted to the tailgate 10 spaced from the hinge assembly 40 in a second direction. More specifically, the hinge/lock assembly 50 is mounted at or adjacent a third corner of the tailgate formed at the intersection of the first lateral edge 26 and a top edge 52 of the tailgate. The second hinge/lock assembly selectively latches or locks to a second hinge/lock striker 54 to releasably lock the tailgate 10 to the vehicle V. The striker 54 is mounted to or adjacent an upper end of the sidewall end 28. The second hinge/lock assembly 50 cooperates with the hinge assembly 40 to pivotally support the tailgate 10 along or about the second axis and allows the tailgate to move between the tailgate closed position and the swing-open position.

A lock or locking assembly 60 attaches or is mounted to the tailgate 10 at or adjacent a fourth corner of the tailgate formed at the intersection of the top edge 52 and the second lateral edge 44 of the tailgate. The locking assembly 60 selectively latches to a locking striker 62 to releasably lock the tailgate to the vehicle V. The striker 62 is mounted to or adjacent an upper end of the second sidewall end 48. The tailgate 10 is openable toward or to the fold-open position when both the second hinge/lock assembly 50 is unlatched from the second hinge/lock striker 54 and the locking assembly 60 is unlatched from the locking striker 62. The tailgate 10 is openable toward or to the swing-open position when both the first hinge/lock assembly 42 is unlatched from the first hinge/lock striker 46 and the locking assembly 60 is unlatched from the locking striker 62.

The tailgate 10 can include one or more handles 64 for operating the tailgate and opening the tailgate to the swing-open and flip-down positions. The operation of the first and second hinge/lock assemblies 42,50 and the one or more handles 64 relative to one another is not described in further detail herein. However, in one embodiment, the system for operating and controlling the dual-mode tailgate 10 could be that described in commonly owned, U.S. patent application Ser. No. 10/894,951, entitled "Dual Mode Tailgate Control System" and filed on Jul. 20, 2004, expressly incorporated herein by reference.

Figure 3:
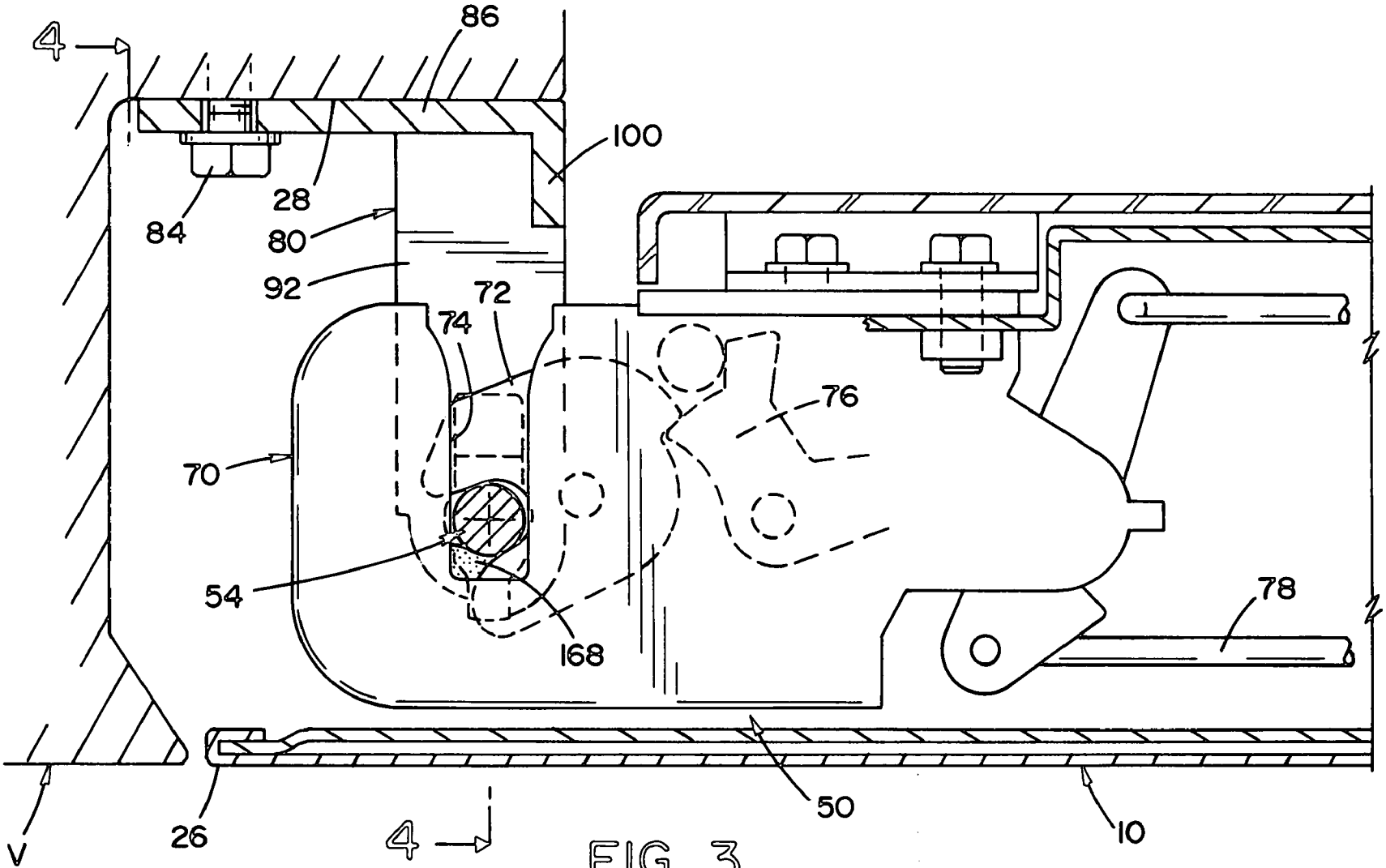
FIG. 3 is a partial cross-sectional view of the second hinge/lock assembly and a striker assembly to which the hinge/lock assembly is latched taken along the line 3—3 of FIG. 2.

With additional reference to FIG. 3, the second hinge/lock assembly 50, also referred to herein as a lock assembly and a latching assembly, includes a lock body 70 and a latch 72 for selective latching engagement with the striker 54. More specifically, the lock body 70 defines a recess 74 for receiving the striker 54. The latch 72 is rotatably mounted to the lock body 70 for selectively locking the striker 54 within the lock body recess 74 thereby securing the tailgate 10 to the vehicle V. Thus, as will be appreciated by those skilled in the art, when the tailgate 10 is in the closed position (and, also, opening in the swing-open mode), the latch 72 is rotated about the striker 54 to prevent the striker from being removed from the lock body recess 74. A ratchet 76 is employed to maintain the latch 72 in the latched position and can be operable by an actuating device, such as an actuating rod 78. In one embodiment, the locking assembly 50 could be that described in the Application Ser. No. 10/894951, referenced above.

Figure 9:
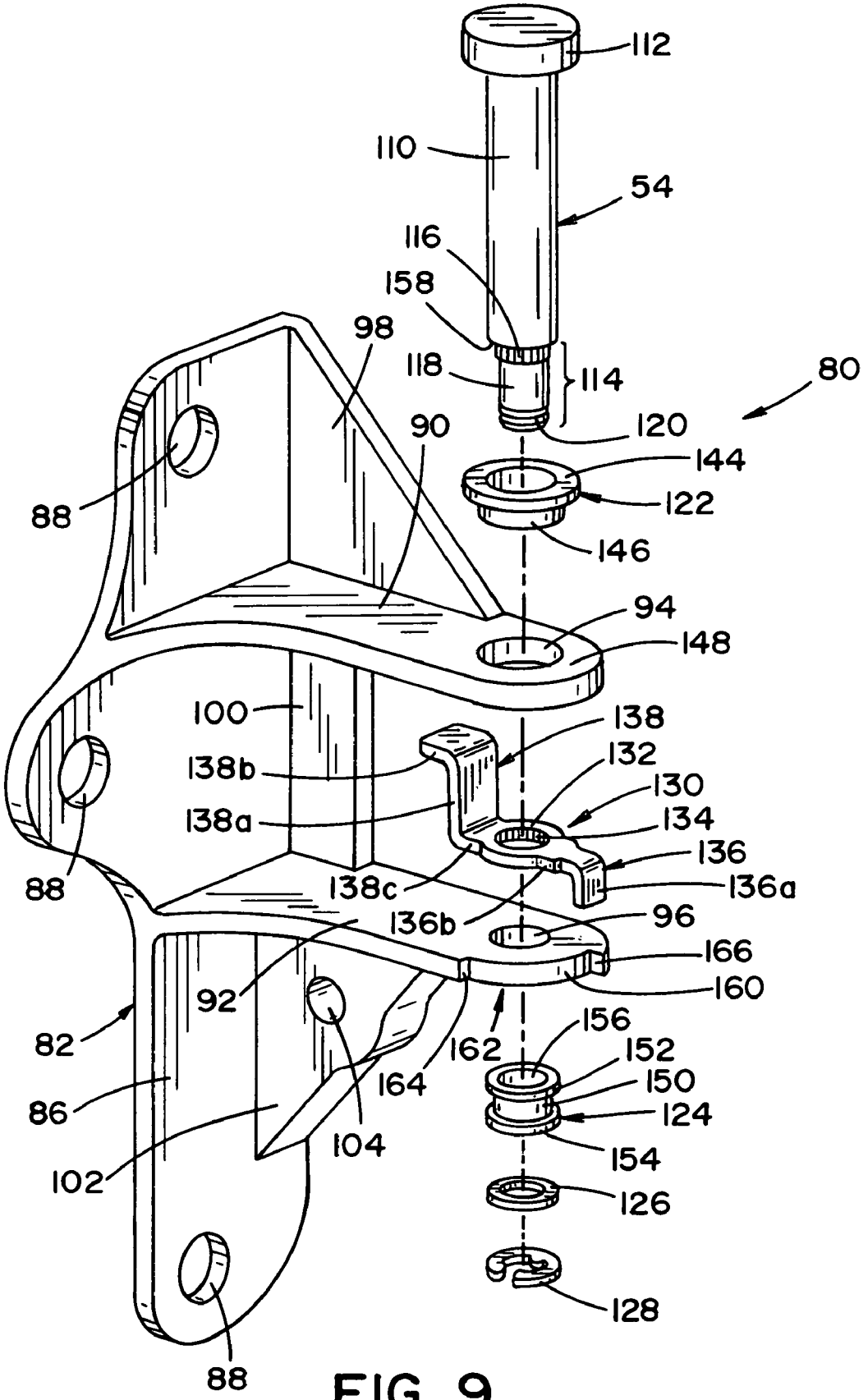
FIG. 9 is a perspective view of the striker assembly of FIG. 3.

In the illustrated embodiment, the striker 54 is a pin that forms one component or element of a striker assembly 80. The striker pin 54 at least partially defines the second axis, also referred to herein as the second pivot axis, about which the tailgate 10 is pivotable to the swing-open position. With additional reference to FIGS. 4 and 9, the striker assembly 80 includes a mounting bracket 82 fixedly secured to the vehicle V and, more particularly, the first sidewall end 28 of the vehicle body by suitable fasteners, such as bolts 84. The mounting bracket 82 rotatably holds the striker 54 thereby rotatably mounting the striker to the vehicle V. More specifically, the mounting bracket 82 includes a base plate 86 having mounting apertures 88 for mounting the bracket 82 against the first sidewall end 28.

The mounting bracket 82 further includes first and second arms 90,92 extending from the base plate 86. The arms 90,92 are spaced apart from one another and the striker 54 is rotatably disposed therebetween. More specifically, the first arm 90 extends from the base plate 86 at an angle approximately normal to the base plate and includes a striker mounting aperture or opening 94. The second arm 92 is spaced from the first arm and also extends from the base plate 86 at an angle approximately normal to the base plate. Like the first arm 90, the second arm 92 includes a striker mounting aperture or opening 96.

Supports 98, 100, 102 extend between the base plate and the arms 90,92. Specifically, the support 98 connects portions of the base plate 86 spaced from the first arm 90 to portions of the first arm spaced from the base plate. The support 100 is connects to each of the arms 90,92 and to the base plate 86. The support 102 connects portions of the base plate 86 spaced from the second arm 92 to portions of the second arm spaced from the base plate. The supports 98,100, 102 function to improve the strength and rigidity of the arms 90,92. The lower support 102 optionally includes an aperture or recess 104 for connecting a support cable 106 with a suitable fastener, such as bolt 108. As is known, the support cable 106 can extend between the vehicle V and the tailgate 10 to provide additional support to the tailgate, particularly when the tailgate is in the flip-open position.

The striker pin 54 includes a shaft portion 110 having a head 112 disposed at a first end and a connecting portion 114 disposed at a second, opposite end. The connecting portion 114 includes a knurled section 116, a shaft section 118 and a threaded section 120. The striker pin assembly 80 further includes bushings or bearings 122,124 that rotatably mount the striker pin 54 in the first and second arms 90,92. Specifically, a first bearing 122 is radially disposed between the striker pin 54 and the first arm aperture 94 and axially disposed along the shaft portion 110 adjacent the head 112. The second bearing 124 is radially disposed between the striker pin 54 and the second arm aperture 96 and axially disposed along the shaft section 118 between the knurled section 116 and the threaded section 120. A washer 126 and locking device 128 are provided for axially locking the pin 54 to the arms 90,92. The washer and locking device 128 are generally disposed adjacent or on the threaded section 120.

The striker pin assembly additionally includes a lever 130 fixedly secured to the striker 54 at the location of the knurled section 116 and extending therefrom in a radial direction. As will be described in more detail below, the lever 130 is engageable with the lock body 70 so that when the tailgate 10 is pivotally moved about the striker 54, as occurs when the tailgate is opened toward the swing-open position, the striker is forced to rotate as a result of the engagement between the rotating lock body 70 and the lever 130. The lever 130 includes ring portion 132 defining an aperture 134 for receiving the shaft section 118 of the striker pin 54. The lever 130 also includes a guiding portion 136 extending in a first direction from the ring portion 132 and an engaging portion 138 extending in a second, opposite direction from the ring portion. The guiding portion 136 is generally L-shaped and has one end thereof extending from the ring portion 132. The engaging portion 138 is generally S-shaped and has one end thereof extending from the ring portion 132.

Figure 4:
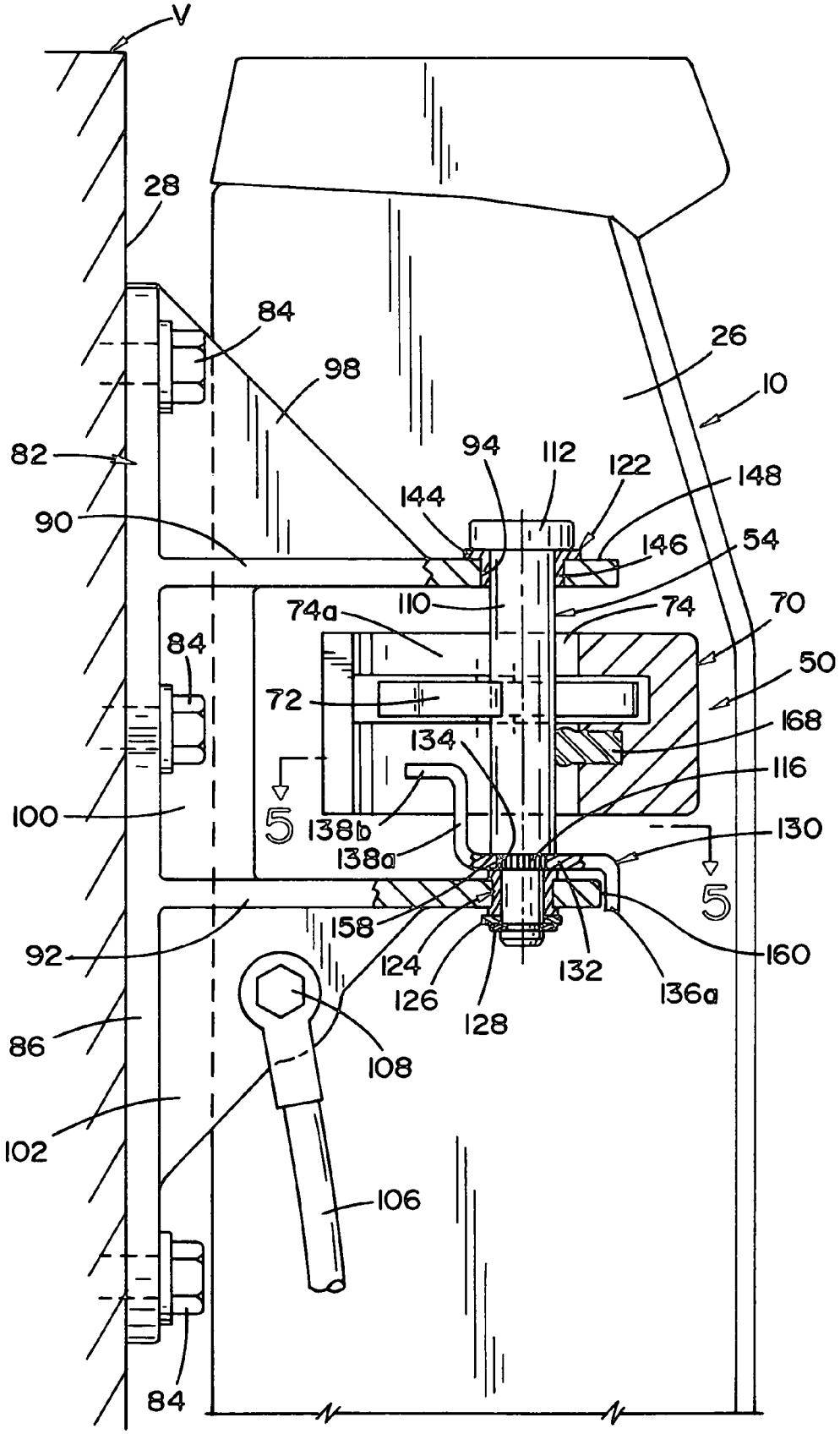
FIG. 4 is a partial cross-sectional view of the second hinge/lock assembly taken along the line 44 of FIG. 3.

In the assembled state shown in FIG. 4, the first bearing 122 of the striker assembly 80 is seated in the first arm aperture 94. More specifically, the bearing 122 includes a radially extending flange portion 144 and a shaft portion 146. The shaft portion 146 is received in the aperture 94 and a the flange portion 144 rests against a top surface 148 of the first arm 90. The striker pin 54 is received through the bearing aperture to rotatably connect the striker pin to the first leg 90 of the bracket 82 and so that the head 112 abuts the radial flange portion 144. The sizing of the head 112 and/orthe sizing of the bearing 122 prevents or limits axial movement of the striker pin 54 in the direction of the second arm 92 (i.e., the head 112 cannot pass through the bearing aperture and the bearing flange portion 144 cannot pass through the first arm aperture 94).

The second bearing 124 is seated in the second arm aperture 96. More specifically, the second bearing 124 includes a shaft portion 150 and a pair of radially extending portions 152,154 disposed at respective ends of the shaft portion 150. The flanges or radially extending portions 152,154 secure the bearing in the aperture 96 and to the second arm 92. The shaft section 118 of the striker pin 54 is received through an aperture 156 defined through the bearing 124 to rotatably connect the striker pin to the second leg 92 of the bracket 82.

As will be described in more detail below, between the shaft portion 110 and the shaft section 118, the lever 130 is fixedly and nonrotatably secured to the striker pin 54 along the knurled section 116. The lever 130 is positioned against a shoulder 158 defined between the shaft portion 110 and the knurled section 116 and against the bearing flange 152. On the other side of the bearing 124, the washer 126 and locking device 128 are annularly received on the threaded end section 120 of the striker pin 54. In the illustrated embodiment, the locking device 128 is an E-ring that, together with the head 112, axially secures the striker pin 54 to the legs 90,92.

In the illustrated embodiment, the lever 130 is secured to the striker pin 54 through an interference or press fit. In the illustrated embodiment, both of the lever surface defining the aperture 134 and the knurled section 116 include knurling for purposes of nonrotatably securing the lever 130 to the striker pin 54 when the interference fit connection is made. Of course, it is to be appreciated by those skilled in the art that the knurling could be provided on only one of the striker pin 54 and the lever 130 or, alternately, another type of connection can be utilized to nonrotatably secure the lever 130 to the striker pin 54. For example, the aperture 134 could have a keyslot shape that mates with a key shape on the striker pin 54 defined in the area of, or instead of, the knurled section 116. Alternately, or in addition to one of the exemplary connections mentioned, an adhesive could be used to secure the lever 130 to the striker pin 54.

The lever 130 is axially positioned on the striker pin 54 so that the ring portion 132 is between the second arm 92 and the location along the shaft portion 110 at which the lock body 70 surrounds the striker pin. As mentioned above, the ring portion 132 is attached to the pin 54 adjacent or abutting the second bearing 124 so the ring portion 132 is positioned closely adjacent the second arm 92 to which the bearing 124 is attached. The positioning of the ring portion 132 ensures that the lever 130 does not interfere with the lock body 70 and latch 72 engagement with the striker pin 54. The S-shaped engaging portion 138 includes a vertical section 138*a* that extends from a general plane of the ring portion 132 a sufficient distance so that an end section 138*b* of the engaging portion is received within the lock body 70 and, specifically, the lock body recess 74 when the striker 54 is received in the lock body recess 74. The engaging portion 138 extends radially from the ring portion 132 and the striker 54 in a direction approximately normal to an axis of the striker pin 54.

Figure 5:
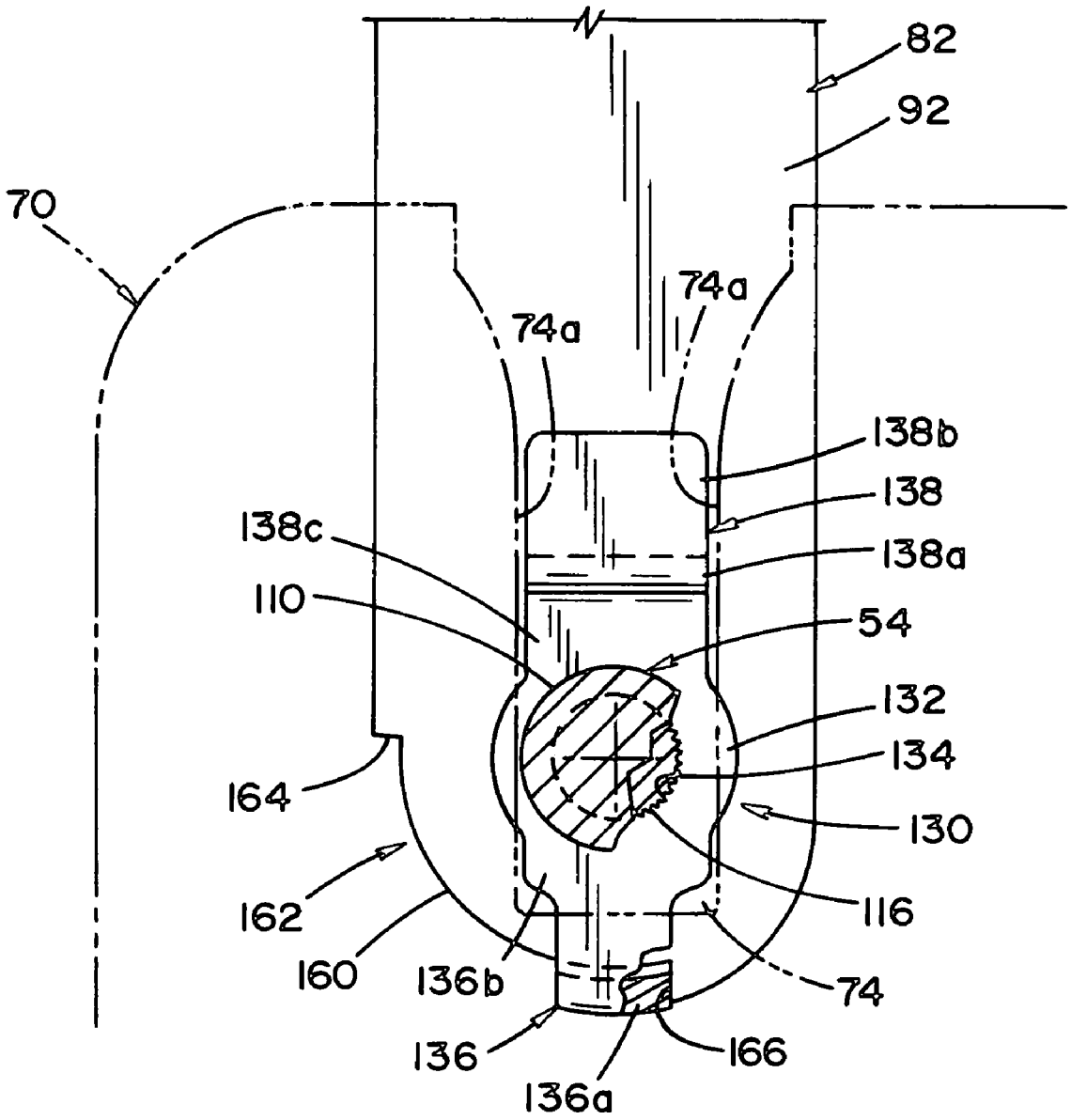
FIG. 5 is a partial cross-sectional view of the striker assembly taken along the line 5—5 of FIG. 4.

The L-shaped guiding portion 136 includes a vertical section 136*a* that extends from the general plane of the ring portion 132 in a direction opposite the vertical section 138*a*. The vertical section 136*a* extends along a surface or face 160 of the lower arm 92. More specifically, with additional reference to FIG. 5, the vertical section 136*a* is received along a notched section 162 of the second arm 92. The notched section 162 includes the face 160 and shoulders 164,166 that define a length of the notched section. The positioning of the vertical section 136*a* within the notched section 162 limits the relative rotation of the striker 54 to the arm 92. In FIGS. 4 and 5, the striker 54 and lever 130 are shown in a first, aligned position. From this position, the striker 54 and lever 130 are rotatable in a first direction (clockwise in FIG. 5) to a second, rotated position wherein the vertical section 136*a* engages or at least approaches the shoulder 164, as well as any position between the first and second positions.

In operation, with continuing reference to FIG. 5, the striker 54 and lever 130 are in the aligned position when the tailgate 10 is in the closed position. The assemblies 42,50,60 are each locked to their respective strikers 46,54,62 when the tailgate 10 is in the closed position. As already described, when the second hinge/lock assembly 50 is in the locked position, the striker 54 is received in the lock body recess 74 and the latch 72 locks the striker 54 within the recess 74 and to the lock body 70. In the illustrated embodiment, the striker 54 engages a bumper 168 (best shown in FIG. 4) provided in the recess 74.

As shown in FIG. 5, when the tailgate 10 is in the closed position and the assembly 54 is locked to the striker 54, a longitudinal length of the lever 130 is generally aligned with a longitudinal length of the recess 74. Moreover, the shape of the lever 130 generally matches or corresponds with the shape of the recess 74. More specifically, the width of the lever substantially matches the width of the recess 74 and the length of at least a portion of the lever 130 (including ring portion 132, adjacent portion 138*c* of S-shaped portion 138, and adjacent portion 136*b* of L-shaped portion 136) matches a length of walls 74*a* defining a rectangular portion of the recess 74.

Figure 6:
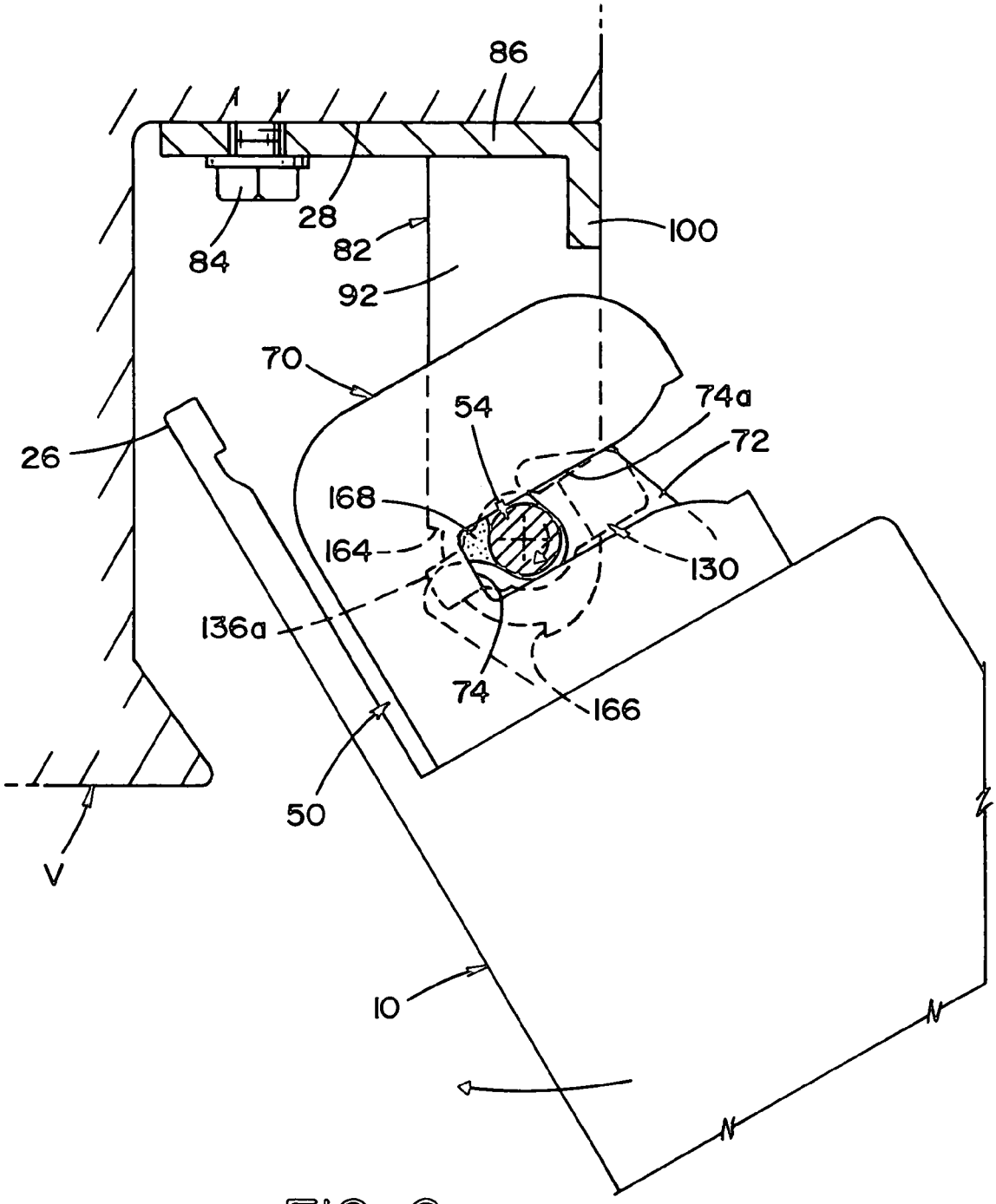
FIG. 6 is a schematic view of the hinge/lock assembly attached to and rotated about the striker assembly when the tailgate is moved toward a swing-open position.

With additional reference to FIG. 6, when the tailgate 10 is opened toward the swing-open position, the lock body 70 engages the lever 130 and thereby rotates the striker pin 54 with the lock body as the tailgate is pivotally moved about the striker pin 54 (which at least partially defines the second pivot axis). Thus, the mating engagement between the lock body 70 and the lever 130 causes the walls 74*a* of the lock body 70 to forcibly rotate the lever 130 to or toward the rotated position. Since the lever 130 is nonrotatably connected to the striker pin 54, rotation of the lever results in rotation of the striker pin 54. With reference to FIG. 5, as the lever 130 is rotated, the guiding portion vertical section 136*a* moves along the notched section 162 and approaches the shoulder 164. As shown in FIG. 6, when the tailgate 10 is opened toward the swing-open position, the latch 72 continues to lock the striker pin 54 within the recess 74 of the lock body 70 thereby continuing to lock the tailgate 10 to the body of the vehicle V.

Forced rotation of the striker pin 54 when the tailgate 10 is rotated thereabout, as described above, has the advantage of limiting wear on the striker pin 54, particularly as compared to a striker pin that is not forced to rotate. Reducing wear likely increases the useful life of the striker assembly 80. Moreover, reducing wear may additionally have the effect of reducing the occurrence of undesirable noises when the tailgate 10 is rotated about the striker pin 54 and allow the tailgate 10 to more smoothly open to the swing-open position.

Figure 7:
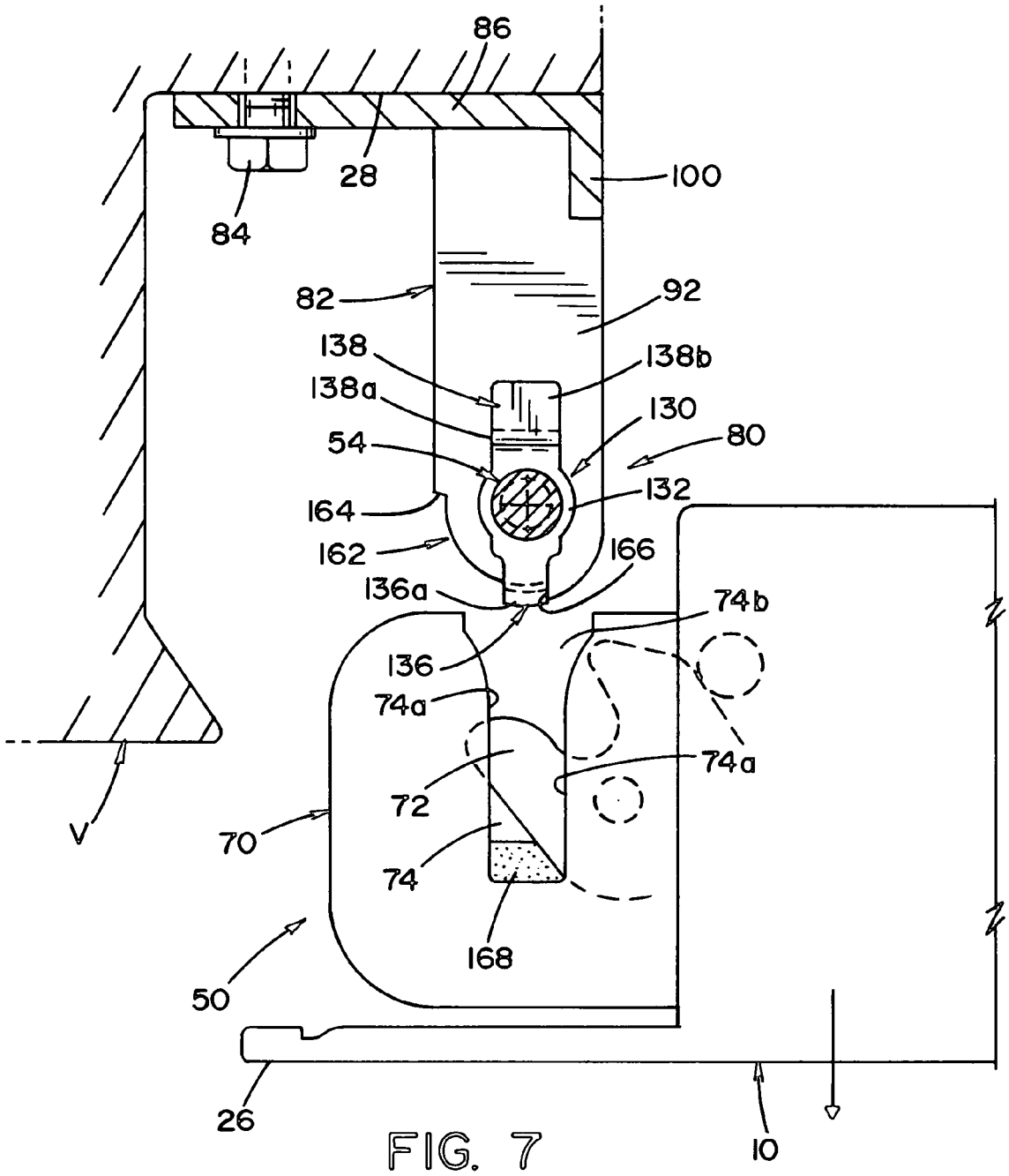
FIG. 7 is a schematic view of the hinge/lock assembly detached from the striker assembly when the tailgate is moved toward a flip-down position.

With reference to FIG. 7, when the latch 72 is released to unlock the lock body 70 from the striker 54, the tailgate 10 can be moved from the closed position (wherein the lever 130 is in the aligned position) toward the flip-down position. As the tailgate 10 is moved from the closed position to the flip-down or flip-open position, the lock body 70 is moved away from the striker assembly 80 and the striker 54 is removed from the recess 74. Since the striker 54 and lever 130 are in the aligned position when the tailgate 10 is closed, the striker 54 and lever 130 generally remain in the aligned position when or as the tailgate is moved toward the flip-down position.

Figure 8:
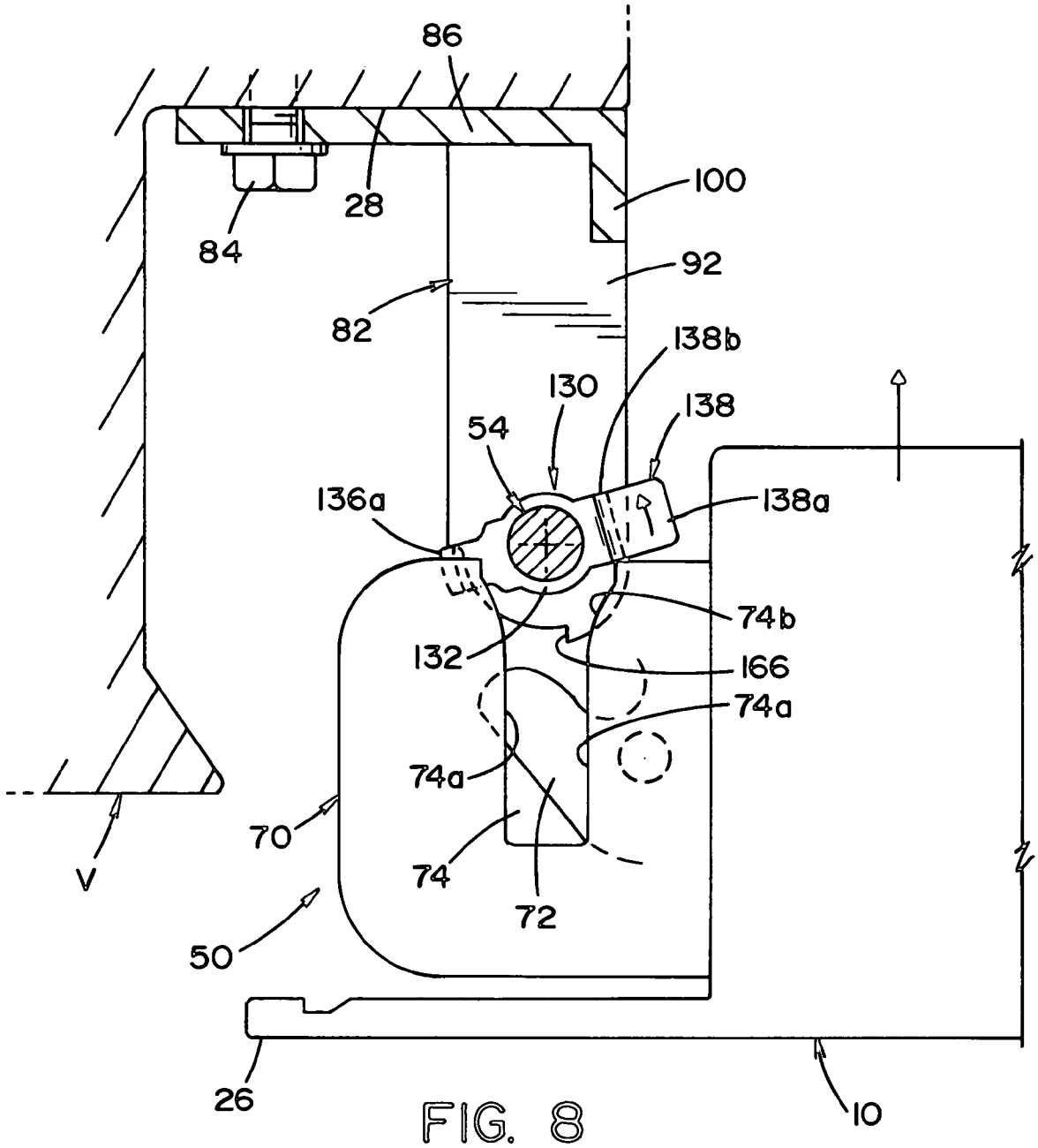
FIG. 8 is a schematic view of the hinge/lock assembly and the striker assembly when the tailgate is moved toward the closed position from the flip-down position.

When the hinge/lock assembly 50 is unlocked from the striker 54, i.e., the latch 72 is released and the lock body 70 is movable away from the striker 54, the striker 54 and lever 130 are rotatable between the aligned position and the rotated position. The configuration of the striker assembly 54 and the configuration of the lock body 70 ensures that the striker 54 and lever 130 will always be in the aligned position when the tailgate is in the closed position. The shoulder 64 of the notched section 162 prevents the lever 130 from rotating beyond the fully rotated position shown in FIG. 8. A fish-mouth opening portion 74*b* of the recess 74 ensures that the recess 74 always captures the lever 130 upon closure of the tailgate 10 from the flip-open position. Should the lever 130 be in the fully rotated position or any position between the rotated position and the aligned position as the tailgate 10 is closed, the walls 74*a* of the lock body 70 defining the recess 74 will engage the lever 130 and force the lever to the aligned position. Thus, the lever 130 is always predictably moved to the aligned position (unless already in the aligned position) when the tailgate 10 is closed.

Although the striker assembly 80 has only been discussed in detail in conjunction with the striker 54 and the second hinge/lock assembly 50, it is to be appreciated by those skilled in the art that the rotatable striker and lever described herein could be applied to the striker 46 and the first hinge/lock assembly 42 so that both hinge/lock assemblies 42,50 of the tailgate 10 include rotatable strikers having levers that force rotation of a respective one of the strikers as the tailgate is rotated about the respective one striker. Additionally, it is to be appreciated that the striker assembly having a rotatable striker with a lever for forcing rotation of the striker could be applied in other applications, including any application where a closure structure is latched closed by latching engagement between a latch and a striker and the closure structure is rotatable or pivotable about the striker.

Still further, according to another embodiment, the striker assembly 80 could be provided for use with a lock assembly, such as the second hinge/lock assembly 50, in latching a first body and a second body together and allowing at least one of the first and second bodies to pivotally move relative to the other of the first and second bodies. For example, the first body could be the tailgate 10 to which the lock assembly 50 is mounted and the second body could be the vehicle body or vehicle V. As already described, the striker assembly 80 includes striker 54 that is rotatably mounted to the second body and configured so that latch 72 of the lock assembly is selectively lockable to the striker 54 to latch the first body to the second body. As also described, lever 130 extends from the striker 54. The lever 130 is engageable with the lock body so that the striker 54 rotates when at least one of the first and second bodies is pivotally moved relative to the other of the first and second bodies.

The exemplary embodiment has been described with reference to the embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A striker assembly for use with a lock assembly in latching a first body and a second body together and allowing at least one of said first and second bodies to pivotally move relative to the other of said first and second bodies, said lock assembly mounted to said first body, the striker assembly comprising:

a striker rotatably mounted to said second body and configured so that an associated latch of said lock assembly is selectively lockable to said striker to latch said first body to said second body; and a lever extending from said striker and engageable with said lock body to rotate said striker about an axis defined thereby when said at least one of said first and second bodies is pivotally moved relative to said other of said first and second bodies about said axis defined by said striker.

2. The striker assembly of claim 1 wherein said lever extends radially from said striker in a direction approximately perpendicular relative to said axis and has a shape that generally matches a recess shape in said lock body.

3. The striker assembly of claim 1 further including:

a mounting bracket fixedly secured to said second body and rotatably holding said striker.

4. The striker assembly of claim 3 wherein said mounting bracket includes a first arm and a second arm spaced from said first arm, said striker rotatably disposed between said first and second arms.

5. The striker assembly of claim 4 further including bearings rotatably mounting said striker to said first and second arms.

6. The striker assembly of claim 1 wherein said lever is attached to said striker by at least one of knurling, press fit, keyslot shape and adhesive.

7. The striker assembly of claim 1 wherein said lever is positioned on said striker so that said lock body aligns said lever when said lock body is closed onto said striker.

8. The striker assembly of claim 1 wherein said lock body engages said lever when said at least one of said first and second bodies is pivotally moved relative to said other of said first and second bodies about said axis defined by said striker to rotate said striker with said lock body.

9. The striker assembly of claim 1 wherein said first body is a tailgate and said second body is a portion of a vehicle main body.

10. The striker assembly of claim 9 wherein said first body is a dual-mode tailgate pivotable about said axis when said latch is selectively locked onto said striker and a second axis oriented approximately normal relative to said axis when said latch is selectively unlocked from said striker and said lock body is a hinge/lock assembly.

11. A striker assembly for use with a latching assembly in latching a closure structure on a vehicle, such as a door or tailgate, and allowing said closure structure to rotatably move relative to a vehicle body, the striker assembly comprising:

a mounting bracket secured to said vehicle body;

a striker pin rotatably mounted to said mounting bracket for latching engagement by said latching assembly of said closure structure; and a lever radially extending from said striker pin for mating engagement by said latching assembly and to rotate said striker pin when said closure structure is rotatably moved relative to said vehicle body about an axis of said striker pin with said latching assembly in latching engagement with said striker pin.

12. The striker assembly of claim 11 further including:

at least one bushing rotatably securing said striker pin to said mounting bracket.

13. The striker assembly of claim 11 wherein said bracket includes first and second arms between which said striker pin is rotatably secured.

14. The striker assembly of claim 13 wherein said striker pin includes at least one head for limiting axial movement of said striker pin relative to said arms.

15. The striker assembly of claim 11 wherein said lever is moved to an aligned position when said closure structure is moved toward a closed position by said latching assembly and is rotated by said latching assembly when said closure structure is rotatably moved thereby rotating said striker pin.

16. The striker assembly of claim 15 wherein said lever is rotatable between said aligned position and a rotated position, engagement between said lever and said mounting bracket prevents said lever from rotating beyond said rotated position.

17. The striker assembly of claim 11 wherein said closure structure is a tailgate.

18. A striker assembly for use with a latching assembly in latching a closure structure on a vehicle, such as a door or tailgate, and allowing said closure structure to rotatably move relative to a vehicle body, the striker assembly comprising:

a mounting bracket secured to said vehicle body:

a striker pin rotatably mounted to said mounting bracket for latching engagement by said latching assembly of said closure structure; and a lever extending radially from said striker pin in a direction approximately normal to an axis of said striker pin for mating engagement by said latching assembly and to rotate said striker pin when said closure structure is rotatably moved relative to said vehicle body.

19. A striker assembly for latching onto when locking a tailgate to a vehicle, said tailgate including a locking assembly having a latch, said striker assembly comprising:

a striker rotatably mounted to said vehicle for latching engagement with said latch when locking said locking assembly of said tailgate to said vehicle, said striker defining a pivot axis about which said tailgate is pivotable; and a lever extending from said striker for mating engagement with said locking assembly, said lever rotating said striker when said tailgate with said locking assembly is pivotally moved about said pivot axis.

20. The striker assembly according to claim 19 wherein said striker is an elongated cylindrical striker pin rotatably disposed between a pair of extending arms and said lever extends radially from said striker pin, and said lever having a shape that mates with a recess of said locking assembly.

21. A striker assembly for use with a lock assembly of a dual-mode tailgate which is selectively openable to a swing-open position about a first axis and alternatively to a fold-open position about a second axis, said striker assembly comprising:

a striker rotatably mounted to a vehicle body to which the dual-mode tailgate is mounted, the lock assembly selectively lockable to said striker and movable about an axis of said striker when the dual-mode tailgate is moved to one of the swing-open position and the fold-open position, said axis of said striker being a corresponding one of the first axis and the second axis, the lock assembly selectively unlocked from said striker when the dual-mode tailgate is moved to the other of the swing-open position and the fold-open position; and a lever extending from said striker for engagement by the lock assembly, engagement of the lock assembly with the lever causing said lever to pivotally move said striker about said axis of the striker when the lock assembly is locked to said striker and moved about said axis of said striker as the dual-mode tailgate is moved to said one of the swing-open position and the fold-down position.

* * * * *